US008026889B2

(12) United States Patent
Tazuke

(10) Patent No.: US 8,026,889 B2
(45) Date of Patent: Sep. 27, 2011

(54) DRIVE CIRCUIT OF DISPLAY DEVICE AND METHOD OF TESTING THE SAME

(75) Inventor: Toshikazu Tazuke, Shiga (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 941 days.

(21) Appl. No.: 11/907,579

(22) Filed: Oct. 15, 2007

(65) Prior Publication Data

US 2008/0094385 A1 Apr. 24, 2008

(30) Foreign Application Priority Data

Oct. 19, 2006 (JP) ..... 2006-285281

(51) Int. Cl.
*G09G 3/36* (2006.01)
*G09G 5/10* (2006.01)

(52) U.S. Cl. ..... 345/98; 345/89; 345/100; 345/690

(58) Field of Classification Search ..... 345/904, 345/100, 98, 89, 204, 609; 348/180; 324/713
See application file for complete search history.

(56) References Cited

U.S. PATENT DOCUMENTS

| | | | | |
|---|---|---|---|---|
| 5,570,105 | A * | 10/1996 | Koyama | 345/98 |
| 6,310,593 | B1 * | 10/2001 | Nakao | 345/87 |
| 6,766,266 | B1 * | 7/2004 | Sakaguchi | 702/117 |
| 6,833,715 | B2 * | 12/2004 | Sakaguchi et al. | 324/713 |
| 7,358,953 | B2 * | 4/2008 | Makuuchi et al. | 345/100 |
| 7,659,878 | B2 * | 2/2010 | Endou et al. | 345/100 |
| 7,859,268 | B2 * | 12/2010 | Okuzono et al. | 324/527 |
| 2005/0122300 | A1 * | 6/2005 | Makuuchi et al. | 345/95 |

FOREIGN PATENT DOCUMENTS

JP 2002-32053 1/2002

* cited by examiner

*Primary Examiner* — Richard Hjerpe
*Assistant Examiner* — Alecia D English
(74) *Attorney, Agent, or Firm* — McGinn IP Law Group, PLLC

(57) ABSTRACT

A first switch circuit is provided between a gradation voltage selection circuit and an output circuit. The output circuit includes a test switch that disconnects the gradation voltage selection circuit from the output circuit in a test mode; a test switch that connects, in the test mode, the gradation voltage selection circuit to a tester connection terminal TESR1; and a test switch that connects, in the test mode, the output circuit to a tester connection terminal TESR2. A second switch circuit is provided between a gradation voltage generation circuit and the gradation voltage selection circuit to disconnect, in the test mode, the gradation voltage generation circuit from the gradation voltage selection circuit.

8 Claims, 7 Drawing Sheets

DRIVE CIRCUIT OF DISPLAY DEVICE AND METHOD OF TESTING THE SAME

BACKGROUND OF THE INVENTION

1. Field of the Invention

The present invention relates to a drive circuit of a display device, and a method of testing the same, and particularly to a drive circuit of a display device having a test circuit.

2. Description of Related Art

As shown in FIG. 4, a general liquid crystal display device, which is used as a dot matrix display device, is made of a liquid crystal display panel 101, a data side drive circuit 102, a scanning side drive circuit 103, a power supply circuit 104 and a control circuit 105.

The liquid crystal display panel 101 includes: data lines 106, which are arranged on the drawing in a horizontal direction, and which extend in a vertical direction; and scanning lines 107, which are arranged on the drawing in a vertical direction, and which extend in a horizontal direction. Each pixel is made of a TFT 108, a pixel capacitor 109, and a liquid crystal element 110. A gate terminal of the TFT 108 is connected to a scanning line 107, and a source (drain) terminal thereof is connected to a data line 106. Further, to the drain (source) terminal of the TFT 108, both the pixel capacitor 109 and the liquid crystal element 110 are connected. A terminal 111 on the side where the pixel capacitor 109 and the liquid crystal element 110 are not connected to the TFT 108 is connected, for example, to a common electrode, which is not shown.

The data side drive circuit 102 outputs an analog signal voltage on the basis of a digital image signal (hereinafter referred to as data), and drives the data lines 106. The scanning side drive circuit 103 outputs a selection/non-selection voltage of the TFT 108, and drives the scanning lines 107. The control circuit 105 controls timings of drive of each of the scanning side drive circuit 103 and the data side drive circuit 102. The power supply circuit 104 generates a signal voltage, which is outputted by the data side drive circuit 102, and a selection/non-selection voltage, which is outputted by the scanning side drive circuit 103, and supplies those voltages to the respective drive circuits. As described below, the present invention relates to the data side drive circuit 102.

In many cases, the data side drive circuit 102 is made of a plurality of driver circuits each formed of a semiconductor integrated circuit device. For example, when the resolution of a liquid crystal panel is XGA (1024×768 pixels: each pixel is composed of three dots of R(red), G(green) and B(blue)), the data side drive circuit 102 is made of 8 driver circuits so that each driver circuit is designed to take partial charge of the display of 128 pixels.

FIG. 5 is a block diagram showing a general driver circuit 1, and FIG. 6 is a timing chart for each signal inputted to the driver circuit 1 shown in FIG. 5. In order to take partial charge of the display of m pixels, each driver circuit 1 outputs signals of S1 to Sn to the data lines 106 of the number n=m×3 dots. Incidentally, in order to simplify the description, the description will be provided assuming that data are serially inputted to the driver circuit 1 with a bit width of data corresponding to one output of S1 to Sn, that is, one dot of one pixel. The driver circuit 1 includes a shift register 2, a data register 3, a data latch circuit 4, a level shifter 5, a D/A converter 6 and an output circuit 7. An output of the shift register 2 of the driver circuit 1 is outputted to a subsequent driver circuit in cascade, and the data side drive circuit 102 is configured in such a way that the multiple driver circuits 1 are connected to one another in cascade.

The shift register 2 is formed of n-steps of registers and is supplied with shift start pulses and clocks. The shift register 2 sequentially shifts the start pulses at timings of the clocks, and thereby generates shift pulses (SP1) to (SPn) shown in FIG. 6.

The data register 3 is formed of n-steps of registers. The n-steps of registers are supplied in parallel with data, and sequentially hold the data, for example, at the timings of falling edges of the shift pulses (SP1) to (SPn) supplied by the shift register 2.

Once data input to every register of the data register 3 is terminated, the data latch circuit 4 is supplied with a data latch signal, and latches all the data which have been held in every register of the data register 3. As for data latched by the data latch circuit 4, a level is shifted by the level shifter 5 as needed.

The D/A converter 6 is one decoding the data of the shifted level and outputting a gradation voltage, and includes a gradation voltage generation circuit and a gradation voltage selection circuit to be described later. The gradation voltage generation circuit is supplied with a gradation reference voltage, and the gradation voltage selection circuit selects and outputs a voltage of 64 gradations, for example. The output circuit 7 amplifies an output of the D/A converter 6 and outputs the resultant output as output signals S1 to Sn. The output circuit 7 is supplied with a data latch signal and a polarity inversion signal, which are also supplied to the data latch circuit 4, and selects and outputs an output of a polarity depending on the polarity inversion signal at a timing of the data latch signal.

Next, the D/A converter 6 and the output circuit 7 are described with reference to FIG. 7. For example, in the case of a dot inversion drive system and a 262144-color display (each of R, G and B has 64 gradations), the driver circuit 1 is configured so that signal voltages of positive and negative polarities can be outputted alternately in 64 gradations from each output S1 to Sn to a common electrode. However, for the purpose of simplifying the description, FIG. 7 only shows one output in which a signal voltage of positive polarity can be outputted in 4 gradations.

A D/A converter 6 includes a gradation voltage generation circuit 11 and a gradation voltage selection circuit 12. The gradation voltage generation circuit 11 is formed of a ladder resistance (not shown) and is supplied with a gradation reference voltage so that the gradation voltage generation circuit 11 generates voltages γ1 to γ4 of 4 gradations. The gradation voltage selection circuit 12 is formed of a plurality of switches (transistors), and selects, from among the gradation voltages γ1 to γ4, a desired gradation voltage depending on data, and outputs a voltage thus selected.

The output circuit 7 includes: an AMP 7*a*, which amplifies and outputs an output depending on a polarity from the D/A converter 6; and a switch (hereinafter referred to as an off switch) 7*b*, which controls ON/OFF of an output of the AMP 7*a*. As shown in FIG. 6, the off switch 7*b* turns off an output depending on a polarity of an amplifier as an output high impedance period in a period from a rising edge of a data latch signal to a falling edge thereof. This is a transition period of the D/A converter 6, and this off switch (TOFFSW) 7*b* is kept off until an electric potential is determined, thus enabling high impedance (Hi-Z).

When abnormality detection of the D/A converter 6 and the output circuit 7 of the driver circuit 1 is tested, a test signal is supplied in general to cause the D/A converter 6 to select a gradation, and an output of the output circuit 7 at that time is measured. The driver circuit 1 includes a large number of switches constituting the gradation voltage selection circuit 12 in the D/A converter 6 to respond to the outputs S1 to Sn, and a test of the driver circuit for testing whether these switches operate normally becomes very complicated. In addition, a characteristic is measured, using an output of the output circuit 7, in a state where the D/A converter 6 and the output circuit 7 are connected. For this reason, when it is determined in an operation test that the characteristic is poor, it is not possible to determine which of the D/A converter 6, the output circuit 7, the gradation voltage generation circuit 11 of the D/A converter 6, or the gradation voltage selection circuit 12 has a defect causing the characteristic to become poor. As a result, a lot of time is required to investigate a cause of the defect and to take measures against the defect. To cope with such a defect, for example, a driver circuit, with which an operation test can be easily and reliably conducted in a very short period of time, is described in Japanese Patent Application Laid-open Publication No. 2002-32053.

In the Publication, a configuration is shown in which a change-over switch is provided between a ladder resistance unit and a selector unit, and in which the selector unit includes: a state change-over circuit outputting a test voltage to the selector unit; and a test control unit. Thus, a test can be conducted by disconnecting the ladder resistance unit, supplying a test voltage directly to the selector unit, and measuring an output from an amplifier unit. As a result, a quick test can be conducted without waiting the stability of an analog gradation voltage, and in addition, a test, in which a large potential difference is set between neighboring voltage lines, is made possible.

In an operation test of the driver circuit described in Patent publication, the ladder resistance unit is disconnected, however, a characteristic is measured, using an output voltage of the amplifier unit, in a state where the selector unit and the amplifier unit are connected. For this reason, when it is determined in an operation test that the characteristic is poor, it is not possible to determine which of the selector unit or the amplifier unit has a defect causing the characteristic to become poor. As a result, as in the case of the driver circuit 1, a lot of time is required to investigate a cause of the defect and to take measures against the defect.

SUMMARY

An aspect of the present invention is the provision of a drive circuit of a display device including a gradation voltage generation circuit which generates a plurality of gradation voltages on the basis of a voltage supplied from a voltage source;

a gradation voltage selection circuit which selects a gradation voltage for the image signal from among the plurality of gradation voltages generated by the gradation voltage generation circuit and outputs the gradation voltage as the analog signal voltage; and an output circuit, which amplifies and outputs an output of the D/A converter, In the drive circuit of the display device.

In a test mode, the gradation voltage generation circuit, the gradation voltage selection circuit, and the output circuit can be disconnected from one another, and thereby each circuit can be separately tested.

According to the present invention, in an operation test of a driver circuit, each of a gradation voltage generation circuit, a gradation voltage selection circuit, and an output circuit can be separately tested. Thus, when it is determined that the characteristic is poor, a defective part can be easily identified, so that time required for investigating a cause of the defect and taking measures against the defect can be reduced.

BRIEF DESCRIPTION OF THE DRAWINGS

The above and other aspects, advantages and features of the present invention will be more apparent from the following description of certain preferred embodiments taken in conjunction with the accompanying drawings, in which.

DETAILED DESCRIPTION OF THE EXEMPLARY EMBODIMENT

Figure 1:
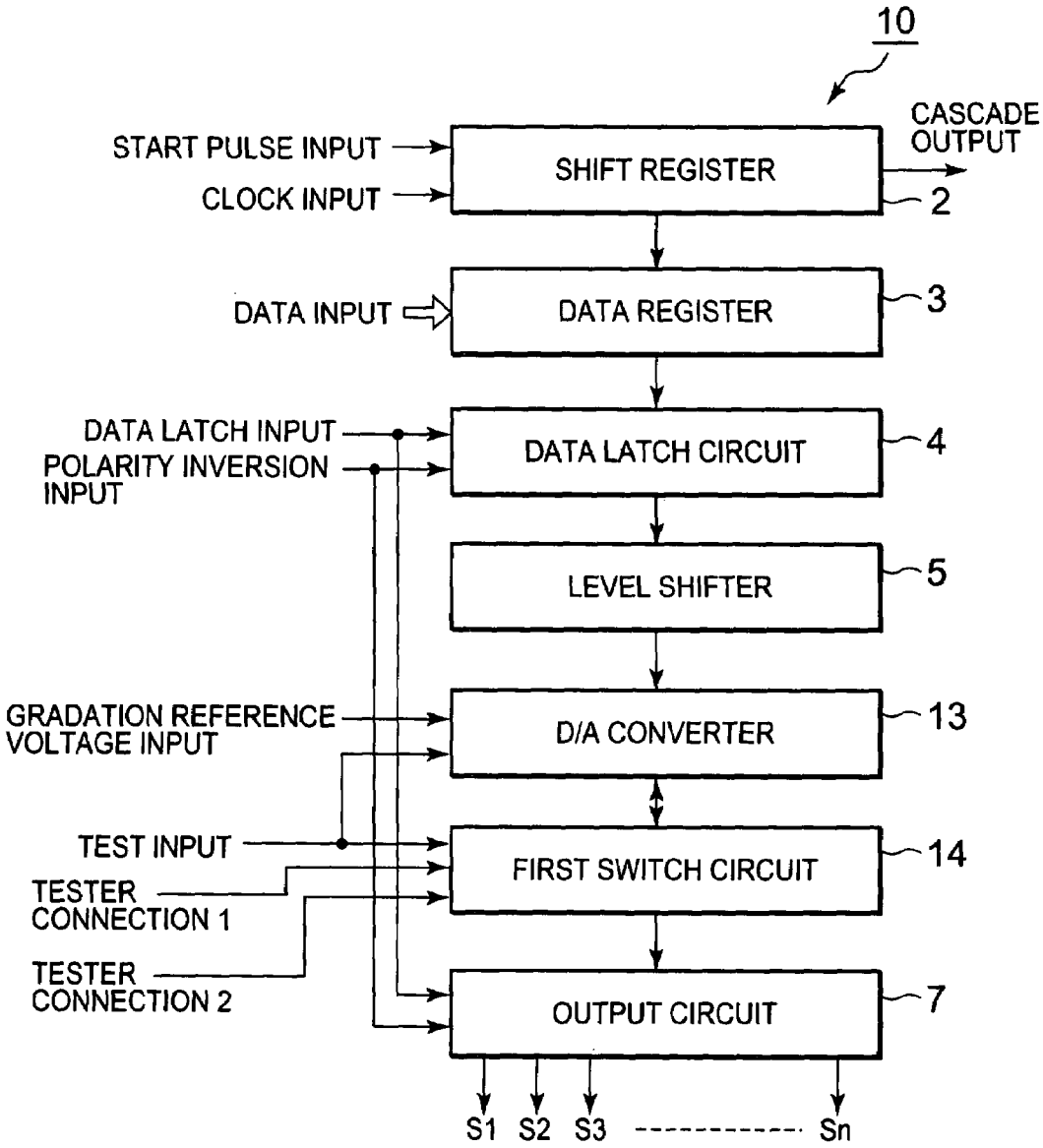
FIG. 1 is a block diagram showing a driver circuit of an embodiment of the present invention.
Figure 2:
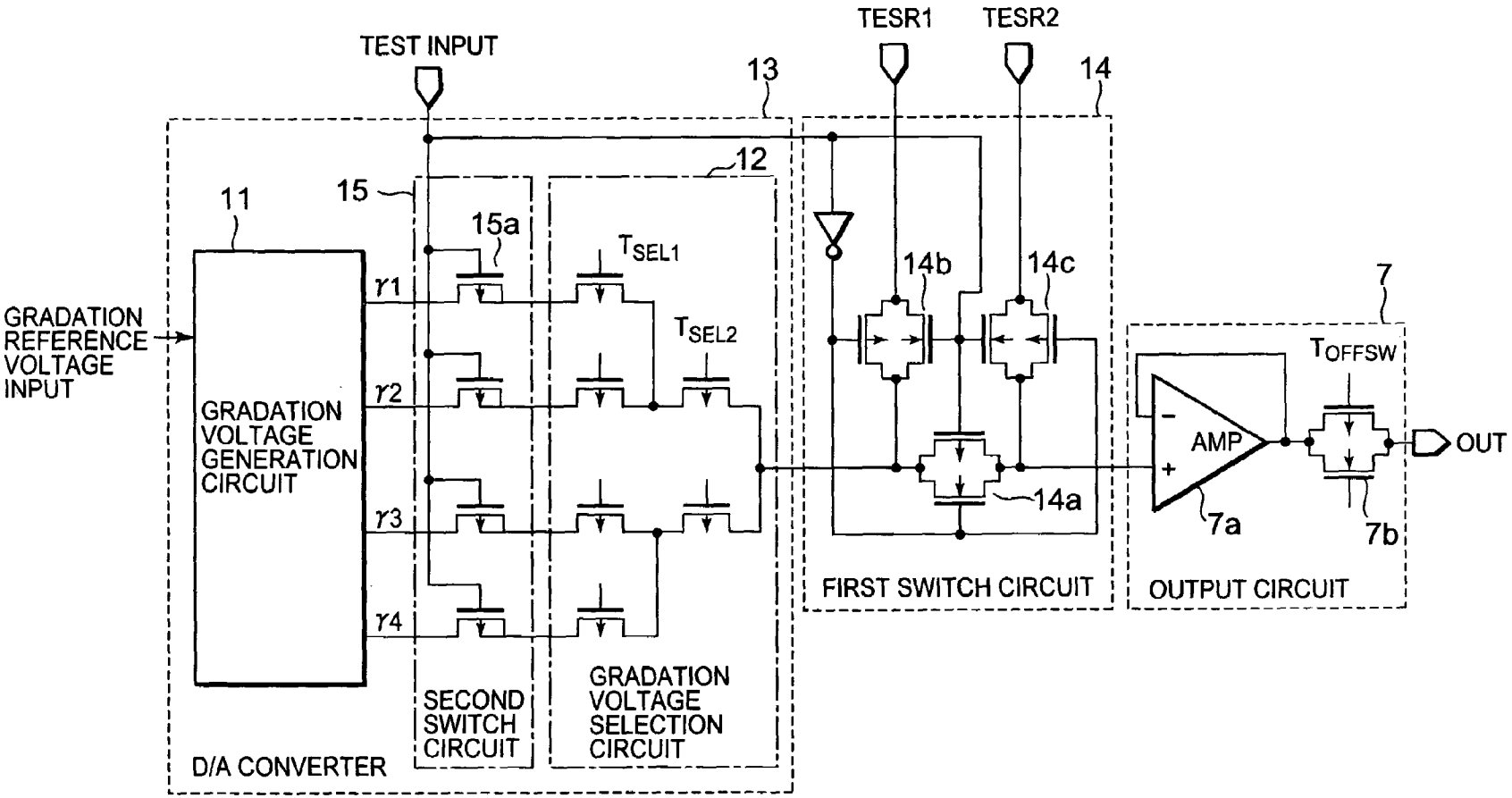
FIG. 2 is a view showing an output from a D/A converter of the driver circuit of FIG. 1.
Figure 5:
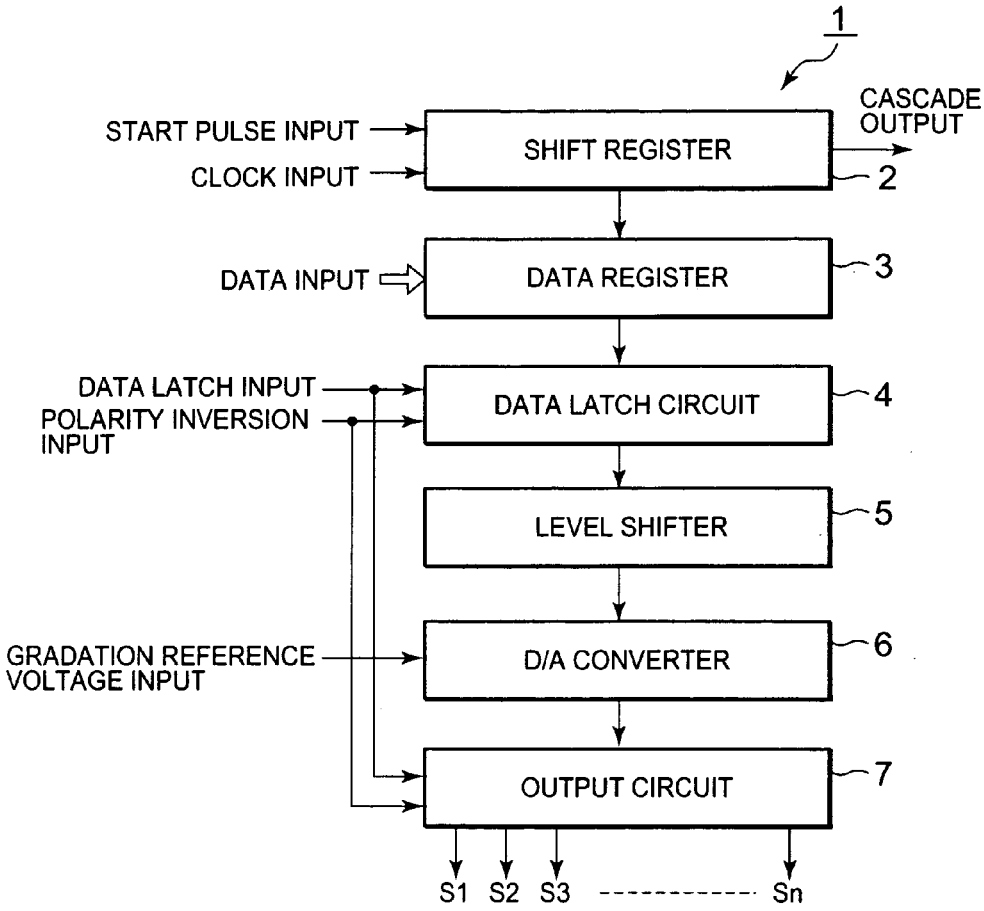
Fig. 5 PRIOR ART
FIG. 5 is a block diagram showing a usual driver circuit.
Figure 6:
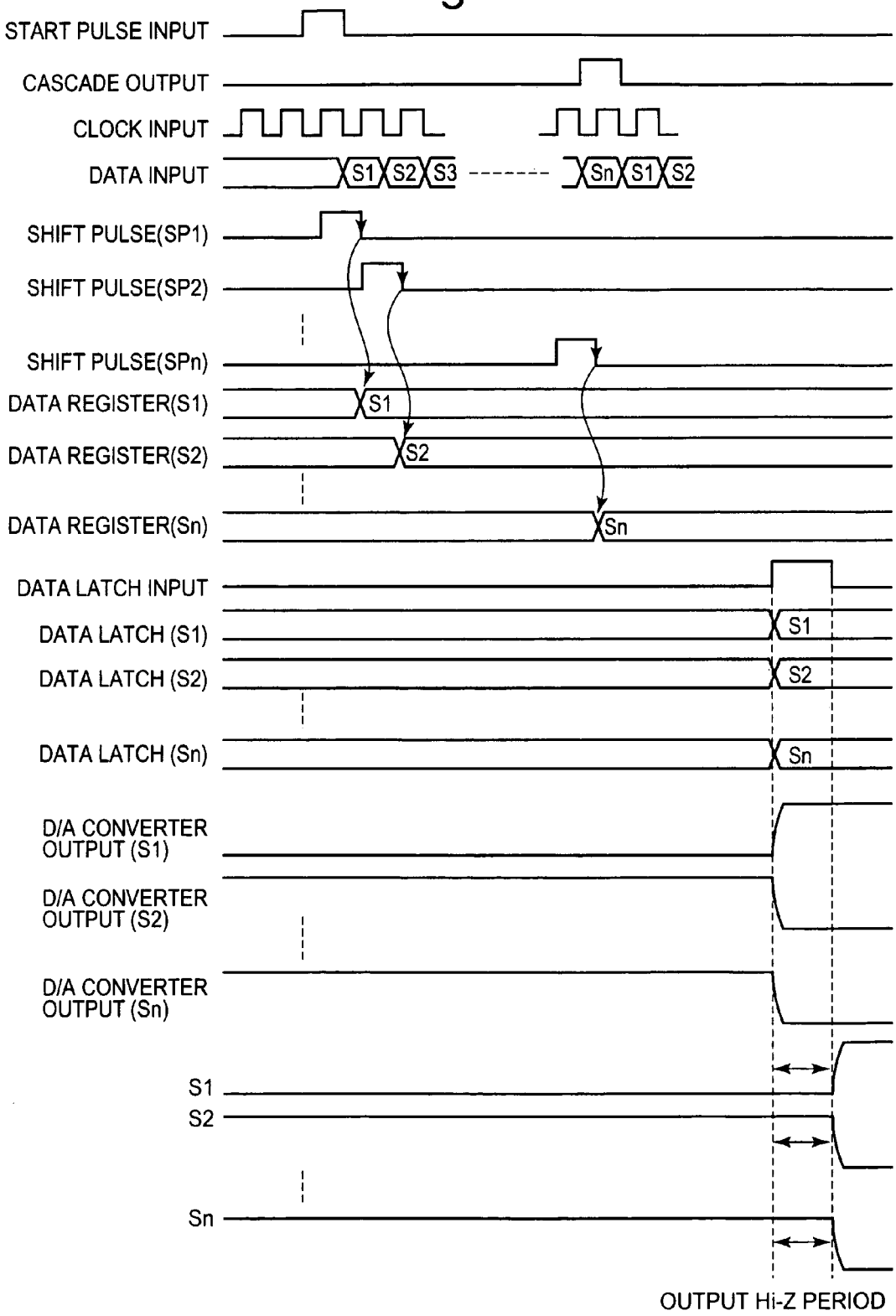
Fig. 6 PRIOR ART
FIG. 6 is a timing chart for each signal inputted to the driver circuit shown in FIG. 5.
Figure 7:
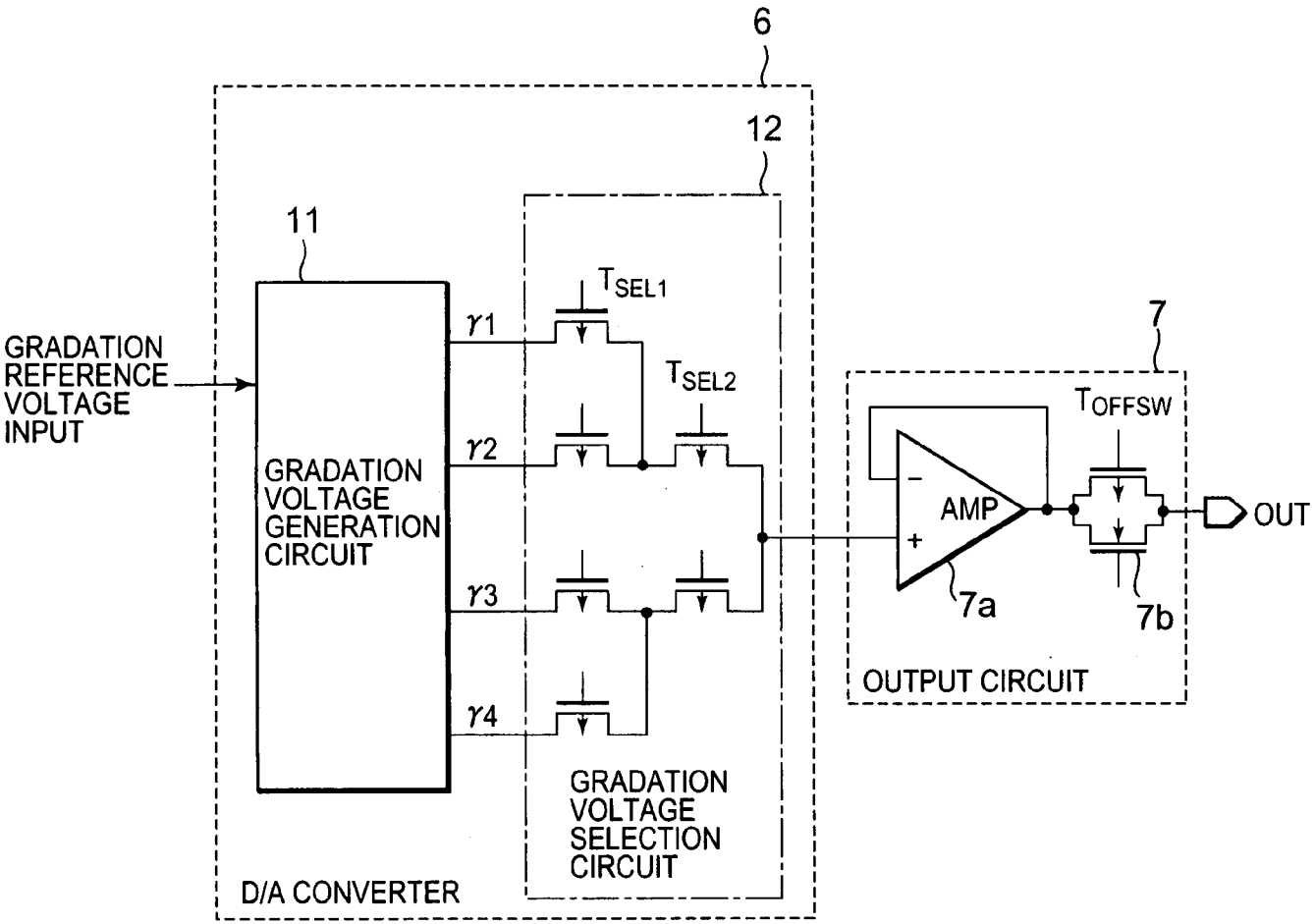
Fig. 7 PRIOR ART
FIG. 7 is a view showing from a D/A converter of the driver circuit of FIG. 5 to an output.

FIG. 1 is a block diagram showing a configuration of a driver circuit 10 of an embodiment of the present invention, and FIG. 2 is a view showing an output from a D/A converter of the driver circuit 10. Those components which are the same as those shown in FIGS. 5 and 7 are given the same reference numerals or symbols, and a description thereof is omitted. A different point of the driver circuit 10 from a driver circuit 1 is that the driver circuit 10 includes a D/A converter 13 in place of the D/A converter 6, and includes a first switch circuit 14 between the D/A converter 13 and an output circuit 7. Further, a different point of the D/A converter 13 from the D/A converter 6 is that the D/A converter 13 includes a second switch circuit 15 between a gradation voltage generation circuit 11 and a gradation voltage selection circuit 12.

The first switch circuit 14 includes test switches 14*a*, 14*b* and 14*c*, each having the same configuration as an off switch 7*b* of the output circuit 7. The test switch 14*a* is connected between an output terminal of the gradation voltage selection circuit 12 and an input terminal of an AMP 7*a*. The test switch 14*b* is connected between a tester connection terminal TESR1 and an output terminal of the gradation voltage selection circuit 12. The test switch 14*c* is connected between a tester connection terminal TESR2 and an input terminal of the AMP 7*a*. When a test signal TEST is inputted, the test switch 14*a* is on-controlled in a normal operation, and off-controlled in a test mode. In addition, when a test signal TEST is inputted, the respective test switches 14*b* and 14*c* are off-controlled in a normal operation, and on-controlled in a test mode.

The second switch circuit 15 includes test switches 15*a* having the same configuration as a switch TSEL1 of the gradation voltage selection circuit 12, and respective voltages γ1 to γ4 of 4 gradations from the gradation voltage generation circuit 11 are supplied to the respective switches TSEL1 through the respective test switches 15*a*. When the test signal TEST is inputted, the test switches 15*a* are on-controlled in a normal operation, and off-controlled in a test mode.

Figure 3:
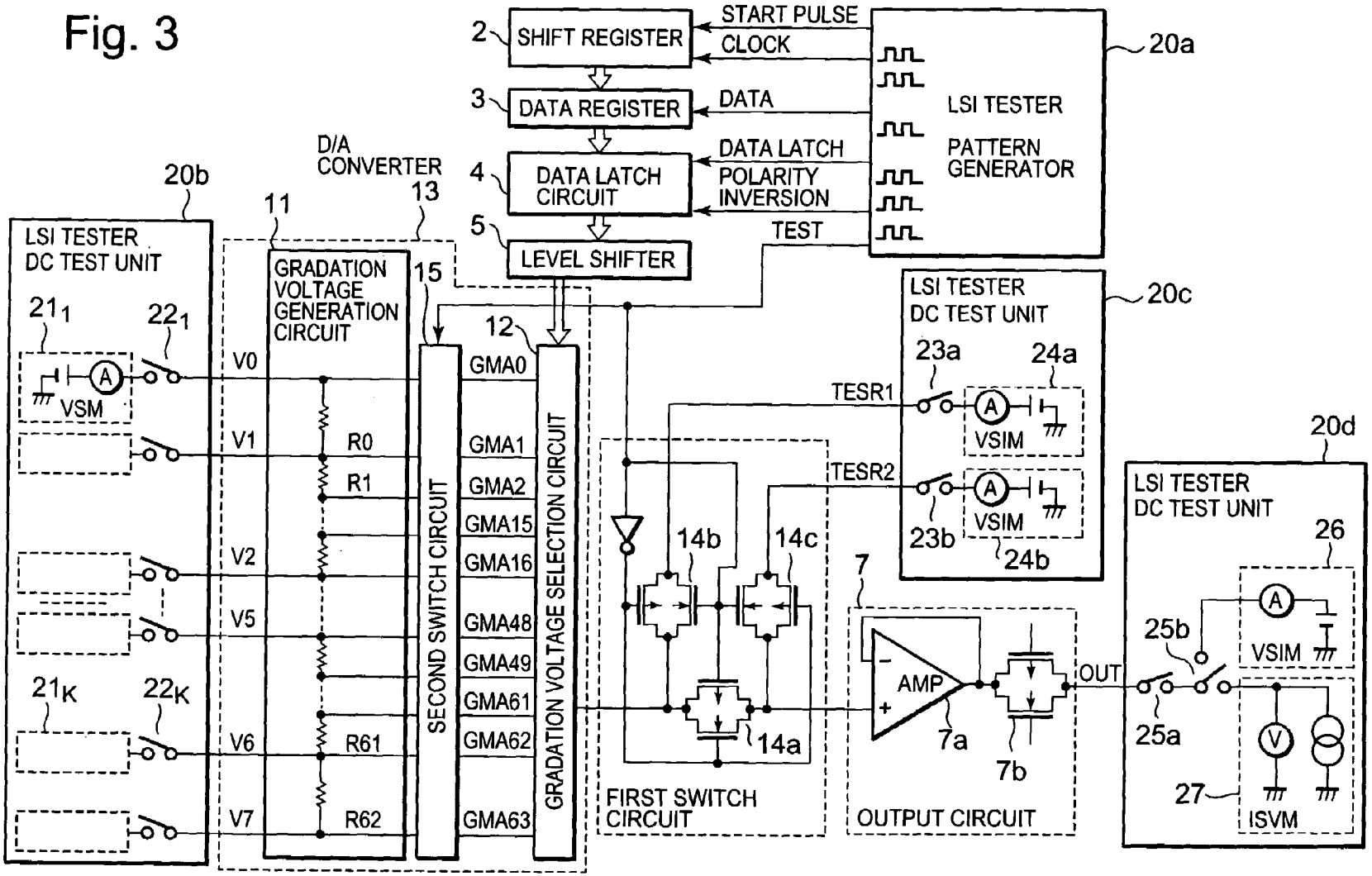
FIG. 3 is a view showing a specific example of a test device of the driver circuit of FIG. 2 of the embodiment of the present invention.
Figure 4:
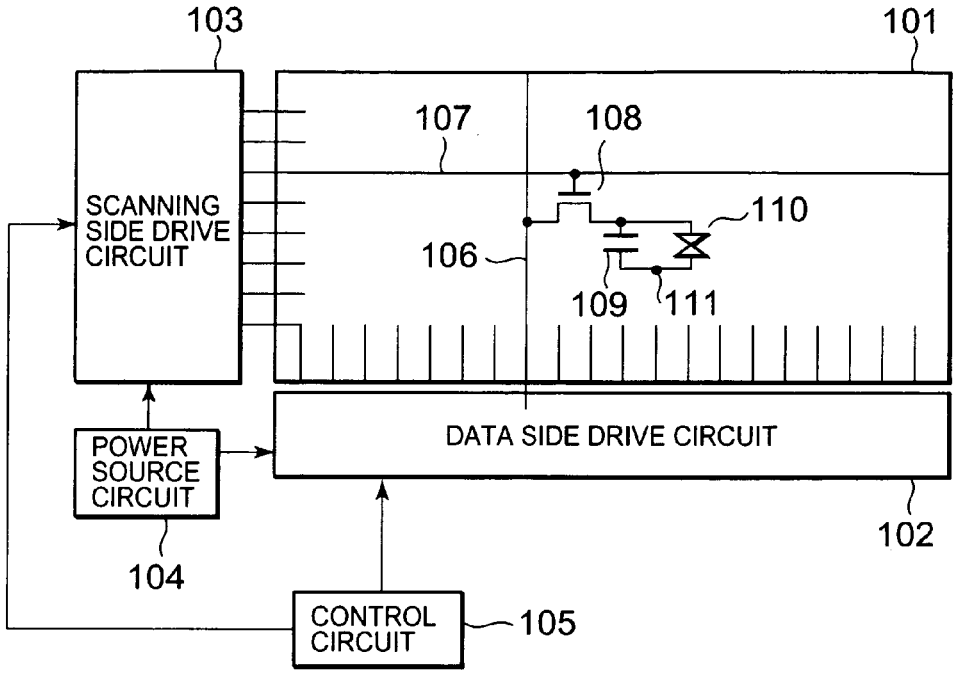
Fig. 4 PRIOR ART
FIG. 4 is a block diagram showing a usual liquid crystal display device.

Methods of testing the gradation voltage generation circuit 11, the gradation voltage selection circuit 12, and the output circuit 7 in the driver circuit 10 having the above-described configuration are described. FIG. 3 is a view showing a test device of the driver circuit of this embodiment. As shown in FIG. 3, the test device includes LSI testers 20*a*, 20*b*, 20*c*, and 20*d*. In the present embodiment, it is assumed that one of gradation voltages having 64 gradations is selected and outputted by the D/A converter 13. In this case, for example, the gradation voltage generation circuit 11 includes 63 resistances R0 to R62, and divides 8 gradation reference voltage inputs V0 to V7 and generates gradation voltages of 64 gradations. The second switch circuit 15 includes 64 input/output terminals corresponding to gradation voltages of 64 gradations, and respective terminals of the resistances R0 to R62 of the gradation voltage generation circuit 11 and input terminals of the second switch circuit 15 are connected. Moreover, the gradation voltage selection circuit 12 includes 64 input terminals GMA0 to GMA63 to which output terminals of the second switch circuit 15 are connected, and selects and outputs one of gradation voltages of 64 gradations on the basis of input data supplied from a level shifter 5.

The LSI tester 20*a* is connected to each of a shift register 2, a data register 3, a data latch circuit 4, the first and second switch circuits 14, 15. The LSI tester 20*a* is a pattern generator, and generates and supplies a start pulse and a clock to the shift register 2, data to the data register 3, and a data latch signal and a polarity inversion signal to the data latch circuit 4. Furthermore, the test signal TEST is generated, and supplied to the first and second switch circuits 14, 15.

The LSI tester 20*b* is connected to an input of the gradation voltage generation circuit 11. The LSI tester 20*b* is a DC test unit, and includes 8 voltage generation current measurement circuits (VSIM) $\mathbf{21}_1$ to $\mathbf{21}_8$ (21*k*) and 8 DC relay switches 22, to $\mathbf{22}_8$ (22*k*) in response to the 8 gradation reference voltage inputs V0 to V7 of the gradation voltage generation circuit 11. The switching of each DC relay switch 22*k* is controlled, whereby an input of the gradation voltage generation circuit 11 and the LSI tester 20*b* are connected to each other. Thus, a voltage is generated to enable a measurement of an electric current.

The LSI tester 20*c* is connected to the first switch circuit 14. The LSI tester 20*c* is a DC test unit, and includes DC relay switches 23*a*, 23*b* and voltage generation current measurement circuits (VSIM) 24*a*, 24*b* in response to the test switches 14*b*, 14*c* of the first switch circuit 14. The respective DC relay switches 23*a*, 23*b* are controlled, whereby the test switches 14*b*, 14*c* and the voltage generation current measurement circuits (VSIM) 24*a*, 24*b* are connected to each other. Thus, a voltage is generated to enable a measurement of an electric current.

The LSI tester 20*d* is connected to an output terminal OUT. The LSI tester 20*d* is a DC test unit, and includes DC relay switches 25*a*, 25*b*, a voltage generation current measurement circuit (VSIM) 26, and a current generation voltage measurement circuit (ISVM) 27. By using the DC relay switch 25*a*, an output corresponding to a predetermined output terminal and the measurement circuit 20*d* are connected to each other, and by using the DC relay switch 25*b*, switching between the voltage generation current measurement circuit (VSIM) 26 and the current generation voltage measurement circuit (ISVM) 27 is controlled. Thus, a voltage is generated to enable a measurement of an electric current, or an electric current is generated to enable a measurement of a voltage.

By the input of a test signal TEST from the LSI tester unit 20*a*, the first switch circuit 14 and the second switch circuit 15 are set to a test mode. When the test signal TEST in a test mode is at "H" level, the test signal TEST is directly inputted in a P-channel-side gate of the test switch 14*a* of the first switch circuit 14 and in N-channel-side gates of the test switches 14*b*, 14*c*, and is inputted through an inverter in an N-channel-side gate of the test switch 14*a* and in P-channel-side gates of the test switches 14*b*, 14*c*. Further, when each test switch 15*a* of the second switch circuit 15 includes a P-channel transistor, the test signal TEST is directly inputted in a gate, and when each test switch 15*a* includes an N-channel transistor, the test signal TEST is inputted through an inverter.

In a test mode, in the first switch circuit 14, once the test switch 14*a* is turned off, the test switches 14*b*, 14*c* are turned on, and, in the second switch circuit 15, each test switch 15*a* is turned off. In the second switch circuit 15, when each test switch 15*a* is turned off, an output of the gradation voltage generation circuit 11 is disconnected from an analog input of the gradation voltage selection circuit 12. In the first switch circuit 14, when the test switch 14*a* is turned off, an output of the gradation voltage selection circuit 12 is disconnected from an input of the output circuit 7. Moreover, when the test switches 14*b*, 14*c* are turned on, the LSI tester 20*c* is connected to an output of the gradation voltage selection circuit 12 and to an input of the output circuit 7.

By the above-described operations of the first switch circuit 14 and the second switch circuit 15, the gradation voltage generation circuit 11, the gradation voltage selection circuit 12 and the output circuit 7 are connected to the LSI testers 20*a*, 20*b*, 20*c*, and 20*d* in the following manner. As for the gradation voltage generation circuit 11, an input thereof is connected to the LSI tester 20*b* in a state where an output of the gradation voltage generation circuit 11 is disconnected from an analog input of the gradation voltage selection circuit 12. As for the gradation voltage selection circuit 12, a digital input thereof is connected to the LSI tester 20*a*, and an output thereof is connected to the LSI tester 20*c*, in a state where an analog input thereof is disconnected from an output of the gradation voltage generation circuit 11, and where an output of the gradation voltage selection circuit 12 is disconnected from an input of the output circuit 7. As for the output circuit 7, an input thereof is connected to the LSI tester 20*c*, and an output thereof is connected to the LSI tester 20*d* in a state where an input thereof is disconnected from an output of the gradation voltage selection circuit 12.

In the above-described test mode, the gradation voltage generation circuit 11, the gradation voltage selection circuit 12, and the output circuit 7 are tested with the LSI testers 20*a*, 20*b*, 20*c*, and 20*d* in the following manner. First, a method of testing the gradation voltage generation circuit 11 is described. When leak currents of γ correction resistances R0 to R62 forming the gradation voltage generation circuit 11, for example, are measured, the switching of each DC relay switch 22*k* is controlled in the LSI tester 20*b*. Then, one of the DC relay switches 22*k* is turned on as needed. Thus, a voltage is generated by using the voltage generation current measurement circuit (VSIM) 21 through a DC relay switch 22*k* thus turned on, so that a leak current can be measured. Further, when a series resistance value of γ correction resistances connected between predetermined two of the 8 gradation reference voltage inputs V0 to V7 of the gradation voltage generation circuit 11 is measured, the switching of each DC relay switch 22*k* is controlled in the LSI tester 20*b*. Then, among these DC relay switches 22*k*, two DC relay switches that are connected to two inputs to be measured are turned on as needed. Next, a potential difference is generated between both ends of a resistance to be measured, by the voltage generation current measurement circuit (VSIM) 21*k* through two DC relay switches which have been turned on. Thus, an electric current flowing through the resistance is measured, whereby a resistance value of the resistance to be measured can be measured.

Subsequently, a method of testing the gradation voltage selection circuit 12 is described. When a leak current of the gradation voltage selection circuit 12, for example, is measured, the switching of the DC relay switch 23*a* is controlled and the DC relay switch 23*a* is turned on, in the LSI tester 20*c*.

Then, a voltage is generated by the voltage generation current measurement circuit (VSIM) 24*a* through the DC relay switch 23*a* thus turned on, thereby enabling a measurement of a leak current. This test is conducted by generating test data of predetermined pattern by using the LSI tester (pattern generator) 20*a* and by turning on/off a switch of the gradation voltage selection circuit 12 on the basis of the generated test data.

Next, a method of testing the output circuit 7 is described. When an output voltage of the output circuit 7, for example, is measured, the switching of the DC relay switch 23*b* is controlled and the DC relay switch 23*b* is turned on, in the LSI tester 20*c*. Then, an input voltage of the AMP 7*a* is set by the voltage generation current measurement circuit (VSIM) 24*b* through the DC relay switch 23*b*. Thereafter, in the LSI tester 20*d*, an output terminal is connected to the measurement circuit 20*d* by the DC relay switch 25*b*, and switched and controlled to the current generation voltage measurement circuit 27 by the DC relay switch 25*b*, whereby a current is generated to enable a measurement of an output voltage. At the time of this measurement, the off switch 7*b* is on-controlled by the LSI tester 20*a*.

In addition, when a leak current of the AMP 7*a* of the output circuit 7, for example, is measured, in the LSI tester 20*c*, the switching of the DC relay switch 23*b* is controlled and the DC relay switch 23*b* is turned on. Then, a voltage is generated by the voltage generation current measurement circuit (VSIM) 24*b* through the DC relay switch 23*b* so as to enable a measurement of the leak current. Moreover, when a leak current, for example, is measured while the off switch 7*b* of the output circuit 7 is in an off state, an output terminal is connected to the measurement circuit 20*d* by the DC relay switch 25*a*, in the LSI tester 20*d*, and switched and controlled to the voltage generation current measurement circuit (VSIM) 26 by the DC relay switch 25*b*, whereby a voltage is generated to enable a measurement of the leak current while the off switch 7*b* is in an off state. A measurement of a leak voltage of the AMP 7*a* and a measurement of a leak current while the off switch 7*b* is an off state can be performed at the same time.

As described above, in a test mode, each of the gradation voltage generation circuit 11, the gradation voltage selection circuit 12, and the output circuit 7 is separately connected to the LSI testers, and tests of the gradation voltage generation circuit 11, the gradation voltage selection circuit 12, and the output circuit 7 can be simultaneously conducted. In the above described test examples, as a test of the gradation voltage generation circuit 11, while a leak current measurement of γ correction resistance and a resistance measurement are switched and performed, a leak current measurement is performed as a test of the gradation voltage selection circuit 12. Concurrently, an output voltage measurement, a leak current measurement of the AMP 7*a*, and a leak current measurement while the off switch 7*b* is in an off state can be switched and performed as a test of the output circuit 7.

In the present embodiment, the second switch circuit 15 is provided between the gradation voltage generation circuit 11 and the gradation voltage selection circuit 12, and the first switch circuit 14 is concurrently provided between the gradation voltage selection circuit 12 and the output circuit 7, whereby the gradation voltage generation circuit 11, the gradation voltage selection circuit 12, and the output circuit 7 are intended to be separately treated. Thus, when it is determined that the characteristic is poor, a defective part can be easily identified, and time required for investigating a cause of the defect and taking measures against the defect can be reduced.

While the invention has been described in terms of several exemplary embodiments, those skilled in the art will recognize that the invention can be practiced with modification within the spirit and scope of the appended claims.

Further, it is noted that, Applicant's intent is to encompass equivalents of all claim elements, even if amended later during prosecution.

What is claimed is:

1. A drive circuit of a display device, comprising:

a gradation voltage generation circuit which generates a plurality of gradation voltages based on a voltage supplied from a voltage source;

a gradation voltage selection circuit which selects a gradation voltage from among the plurality of gradation voltages generated by the gradation voltage generation circuit in response to an inputted image signal, and which outputs the selected gradation voltage as the analog signal voltage;

an output circuit, which amplifies and outputs the analog signal voltage, wherein, in a test mode, the gradation voltage generation circuit, the gradation voltage selection circuit and the output circuit are disconnectable from one another;

a first switch circuit provided between the gradation voltage selection circuit and the output circuit; and a second switch circuit provided between the gradation voltage generation circuit and the gradation voltage selection circuit, wherein the first switch circuit includes:

a first test switch, which disconnects the gradation voltage selection circuit from the output circuit in the test mode;

a second test switch which connects, in the test mode, the gradation voltage selection circuit to a first tester connection terminal; and a third test switch which connects, in the test mode, the output circuit to a second tester connection terminal.

2. The driver circuit of the display device according to claim 1, wherein the second switch circuit includes a fourth test switch which disconnects, in the test mode, the gradation voltage generation circuit from the gradation voltage selection circuit.

3. A method of testing a drive circuit of a display device according to claim 1, said method comprising:

disconnecting, in a test mode, the gradation voltage generation circuit, the gradation voltage selection circuit, and the output circuit from one another;

connecting a first voltage generation current measurement circuit to an input of the gradation voltage generation circuit;

connecting a second voltage generation current measurement circuit to an output of the gradation voltage selection circuit;

connecting a third voltage generation current measurement circuit to an input of the output circuit; and connecting any one of a fourth voltage generation current measurement circuit and a current generation voltage measurement circuit, by switching to each other, to an output of the output circuit.

4. A display driver, comprising:

a gradation voltage selection circuit that responds to an inputted display digital data to produce an analog voltage;

an output circuit that receives said analog voltage to amplify said analog voltage;

a first switch, coupled between said gradation voltage selection circuit and said output circuit, to disconnect said gradation voltage selection circuit from said output circuit in response to a test signal;

a second switch provided between a first test terminal and a connecting portion of said gradation voltage selection circuit and said first switch; and a third switch provided between a second test terminal and a connecting portion of said output circuit and said first switch.

5. The display driver as claimed in claim 4 wherein said output circuit includes an amplifier connected to said first switch and a fourth switch connected to said amplifier.

6. The display driver as claimed in claim 4 wherein each of said first to third switches comprises a first conductivity transistor and a second conductivity transistor.

7. The display driver as claimed in claim 6, wherein said test signal is applied to said first conductivity transistor and an inverted one of the test signal is applied to said second conductivity transistor.

8. The display driver as claimed in claim 4, further comprising a gradation voltage generator and a switch circuit to separate said gradation voltage generator from said gradation voltage selection circuit in response to said test signal.

* * * * *